US006374750B1

(12) United States Patent
Early

(10) Patent No.: US 6,374,750 B1
(45) Date of Patent: Apr. 23, 2002

(54) STRUCTURAL PANEL SYSTEM

(75) Inventor: Stephen R. Early, Olathe, KS (US)

(73) Assignee: Aero Transportation Products, Inc., Independence, MO (US)

( * ) Notice: Subject to any disclaimer, the term of this patent is extended or adjusted under 35 U.S.C. 154(b) by 0 days.

(21) Appl. No.: 09/441,706

(22) Filed: Nov. 16, 1999

(51) Int. Cl.[7] ..... B61D 17/00

(52) U.S. Cl. ..... 105/409; 105/377.01; 105/404; 52/56; 52/783.1; 428/99; 428/221; 296/191

(58) Field of Search ..... 52/49, 56, 82, 52/783.1, 784.14, 784.16, 793.1, 799.11, 630; 410/47; 428/98, 99, 100, 101, 116, 119, 131, 132, 133, 139, 140, 221; 244/119, 123, 120; 114/84, 85, 76, 79 R; 105/238.1, 411, 355, 422, 377.01, 377.05, 397, 404, 400, 409, 401; 296/187, 188, 191, 193

(56) References Cited

U.S. PATENT DOCUMENTS

| | | | | | |
|---|---|---|---|---|---|
| 1,136,792 | A | * | 4/1915 | Goldsmith | 52/783.1 |
| 1,148,002 | A | | 7/1915 | Anderson | |
| 1,484,579 | A | | 2/1924 | Still | |
| 2,012,889 | A | | 8/1935 | McIntyre | |
| 2,074,439 | A | | 3/1937 | Tangerman | |
| 2,697,990 | A | | 12/1954 | Parsons et al. | |
| 2,920,682 | A | | 1/1960 | Lindberg | |
| 2,995,806 | A | | 8/1961 | Allison et al. | |
| 3,538,668 | A | * | 11/1970 | Anderson | 52/783.1 |
| 3,914,062 | A | | 10/1975 | Heininger | |
| 3,914,861 | A | | 10/1975 | Phillips | |
| 3,943,521 | A | | 3/1976 | Phillips | |
| 4,310,132 | A | | 1/1982 | Robinson et al. | |
| 4,353,313 | A | | 10/1982 | Panagin | |
| 4,365,736 | A | | 12/1982 | Stumm | |
| 4,397,434 | A | | 8/1983 | Farnham | |
| 4,417,526 | A | | 11/1983 | Marulic et al. | |
| 4,492,215 | A | | 1/1985 | DiGianvittorio | |
| 4,550,480 | A | | 11/1985 | Tanikawa et al. | |
| 4,807,802 | A | | 2/1989 | Williams | |
| 4,867,327 | A | | 9/1989 | Roland | |
| 4,875,795 | A | | 10/1989 | Anderson | |
| 4,892,435 | A | | 1/1990 | Anderson | |
| 4,894,967 | A | | 1/1990 | Morton | |
| 4,945,488 | A | | 7/1990 | Carver et al. | |
| 4,973,506 | A | * | 11/1990 | Baner et al. | 428/116 |
| 4,993,329 | A | | 2/1991 | Takeich et al. | |
| 4,993,619 | A | | 2/1991 | Kresse, Jr. et al. | |
| 5,086,997 | A | | 2/1992 | Glass | |
| 5,118,552 | A | * | 6/1992 | Sempolinski | 428/98 |
| 5,190,207 | A | | 3/1993 | Peck et al. | |
| 5,244,158 | A | | 9/1993 | Popovich | |
| 5,249,818 | A | | 10/1993 | Patterson | |
| 5,267,515 | A | | 12/1993 | Tsuruda et al. | |
| 5,383,406 | A | | 1/1995 | Vanolo et al. | |
| 5,651,910 | A | | 7/1997 | Myers et al. | |
| 5,768,851 | A | * | 6/1998 | Nagaoka | 52/793.1 |
| 5,803,402 | A | | 9/1998 | Krumweide et al. | |
| 5,806,797 | A | | 9/1998 | Micale | |
| 5,878,940 | A | | 3/1999 | Rosenbalm | |

* cited by examiner

*Primary Examiner*—Mark T. Le
(74) *Attorney, Agent, or Firm*—Chase & Yakimo, L.C.

(57) ABSTRACT

A panel system includes a first skin, a second skin, a web core constructed from sheet material for securing the skins together in a spaced, sandwich relationship, and a connecting means for affixing the web core within the skins. The web core includes a plurality of spaced apart longitudinal members having longitudinally spaced projections extending therefrom and further having transversely aligned, longitudinally spaced slots therein. The web core further includes a plurality of spaced-apart, transverse cross members each having spaced slots therein receiving the longitudinal members at corresponding transversely aligned slots thereof to provide an interlocked grid work between the first and second skins. The grid is connected to the skins utilizing the projections, which extend through slits in the skins in one embodiment to facilitate welding or otherwise bonding the components. In a second embodiment the projections present mounting ears that receive fasteners that extend through the skins.

14 Claims, 10 Drawing Sheets

STRUCTURAL PANEL SYSTEM

FIELD OF THE INVENTION

This invention relates to a multi-purpose panel system which is assembled from precision-made components and has superior mechanical properties. More specifically, the panel system is lightweight and very stiff or self-supporting, utilizes components formed from sheet material and has a low cost of assembly.

BACKGROUND OF THE INVENTION

Various types of sandwich construction panel systems are known. However, these typically employ relatively heavy internal frame components such as channel members and the like that are bent or otherwise formed to the required shape. Also, such systems may be adapted or have been developed for use only in a specific application, such as for aircraft fuselage paneling.

Sandwich flooring systems in present use may have other disadvantages. For instance, they may require a structural underframe to provide sufficient support, depending upon the load to be carried or supported. Other sandwich configurations may have adequate stiffness or rigidity for floor or wall system applications, but they are typically relatively heavy and difficult to assemble.

SUMMARY OF THE INVENTION

Accordingly, a primary object of the subject invention is to provide a lightweight and strong structural panel system including a first skin, a second skin and a web core constructed from sheet material that secures the skins together in a spaced relationship and provides an interlocked grid work between the skins.

Another important object of the subject invention is to provide a panel system having a web core that includes a plurality of spaced apart longitudinal and transverse members which are precision formed of either metal or rigid plastic to fit easily together and thereby present a stiff, rigid, self-supporting structure.

Another important object is to provide such a panel system which, in addition to superior strength and rigidity, has good insulation properties and provides an interior core space that can be used as a duct for fluid flow, evacuated to provide a partial vacuum, or filled with a liquid, particulate material or other fluid as desired for a particular system application.

Another object is to provide such a panel system in which the components thereof may be assembled and produced with close tolerances utilizing simple tooling, thereby assuring that panel sections will be uniform so that they can be readily joined together to present a composite structure of the desired physical size.

Another object of the subject invention is to provide a panel system that is usable in a variety of applications, such as in the construction of any type of cargo carrier (e.g., railroad cars, aircraft and ships), general purpose enclosures and structures, storage tanks and the like.

Still another object is to provide a panel system usable for a variety of purposes, such as wall paneling, flooring, and applications requiring structural reinforcement, superior insulation properties and/or ductwork provided within the panels themselves.

Still another object of the subject invention is to provide a paneling system that when used as flooring does not require a structural underframe.

Still another object is to provide a structural system composed of panel sections which are relatively small and easy to handle, and which are readily connected together to provide a final structure of the desired size and configuration.

Yet another object of the subject invention is to provide an embodiment of such a paneling system that is strong, rigid, lightweight and easy to assemble as aforesaid, and which does not require the use of mechanical connectors.

These objects are attained by providing a paneling system comprising a first skin, a second skin, a web core of sheet material construction for supporting the skins in a spaced relationship, and means for securing the panel components together. The web core includes a plurality of spaced apart longitudinal members having longitudinally spaced projections or ears extending therefrom and transversely aligned, longitudinally spaced slots therein, and further includes a plurality of spaced apart, transverse cross members of similar configuration each having spaced slots therein receiving the longitudinal members at corresponding transversely aligned slots thereof to provide an interlocked grid work between the first and second skins. The projections or ears on the members provide a means to join the core and skins together, either by spot welds or fasteners.

DETAILED DESCRIPTION

Figure 1:
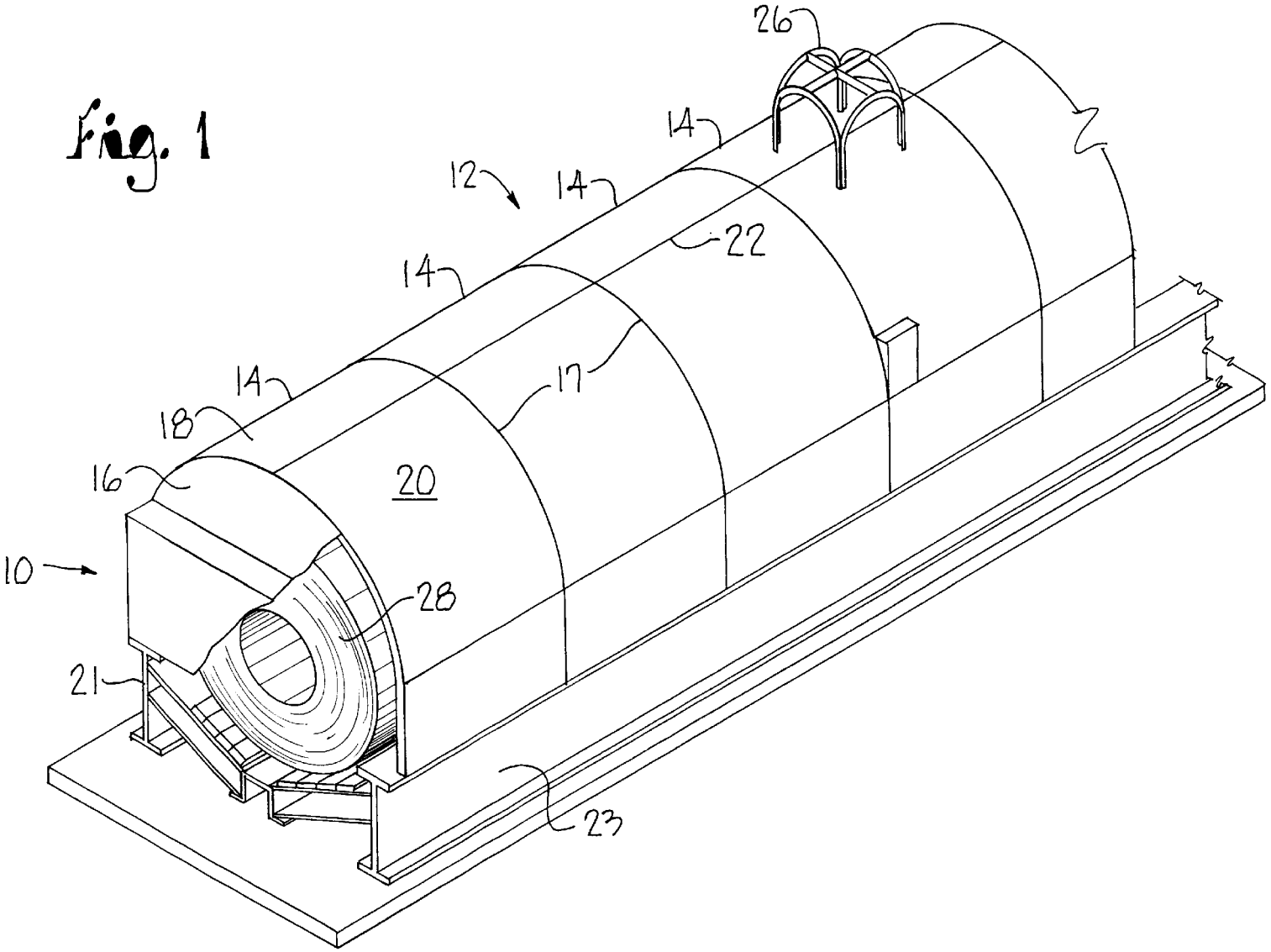
FIG. 1 is a fragmentary, perspective view of a railroad coil car with the coil cover constructed using the panel system of the present invention and with an end broken away to show the coil thereunder.

As shown in FIG. 1, a railroad coil car 10 includes a coil cover 12 thereover, constructed using the structural panel system of the present invention. Although each figure depicts the panel system as forming such a coil cover 12, it should be understood that the panel system has many applications and uses in structures of various types, as discussed above.

Figure 2:
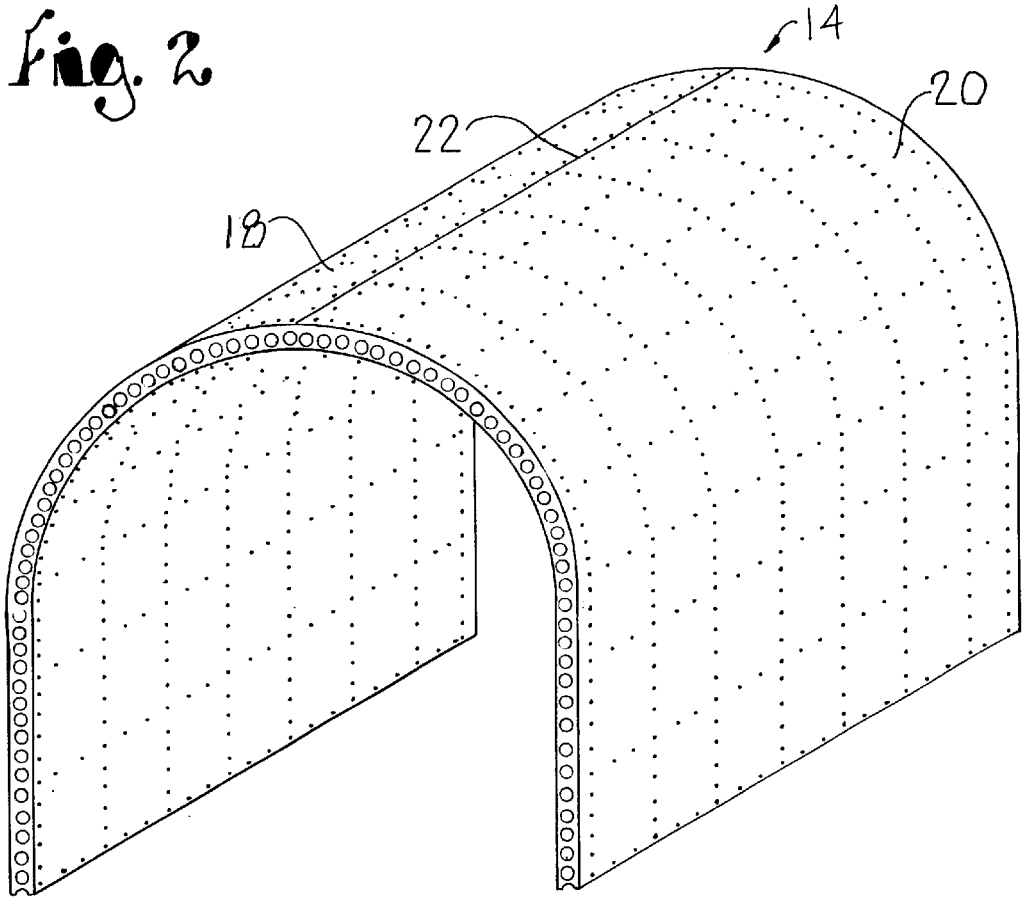
FIG. 2 is a perspective view of one panel section of the coil car cover of FIG. 1.

The coil cover 12 is formed of a plurality of end-to-end sections 14 and end panels 16 (only one shown) secured together. Adjacent sections 14 are secured at their end surfaces to form transverse seams 17. Each section 14 includes two halves, a left and right half 18 and 20, joined together along its top surface to form a central longitudinal seam 22. Left halves 18 are constructed virtually identically to right halves 20, the only difference being that left halves 18 are made as mirror images of right halves 20. FIG. 2 shows a single panel section 14 constructed accordingly.

As shown in FIG. 1, each half 18 and 20 is secured along its bottom surface to the longitudinal side members 21 and 23 of the coil car 10. End panels 16 (only one shown) are secured over the open ends of the first and last panel sections 14 and are preferably constructed to include a stacking ledge 24. Upon removal of the coil cover 12 at lifting cage 26 from over the coil 28, covers may be vertically stacked for efficient storage thereof. An advantage of the cover 12 of the present invention is that its rigidity, particularly its longitudinal stiffness, permits cover 12 to be lifted by a hoist coupled thereto at cage 26, stacked and reused repeatedly without damage or deformation of the cover 12.

FIGS. 3 and 6–11 depict the construction steps employed in forming a panel section half 30 of the type described above with respect to halves 18 and 20 of each section 14. Half 30 in a first embodiment of the present invention includes a top skin or plate 40, a web core member 42 and a bottom skin or plate 44. Top and bottom skins 40 and 44 are thin, flexible metal sheets with rows of evenly spaced rectangular slits 46 therethrough, except that every fifth row of slits 46 is cross-shaped. The web core 42 is an interlocked grid work formed of evenly spaced longitudinal or primary members 48 and transverse cross members 50 preferably laser cut or punched from sheet stock using cutting or punching equipment with computer controls. The sheet material may be steel having a thickness of 1/16th inch, or thinner or thicker depending upon the properties desired.

Figure 5:
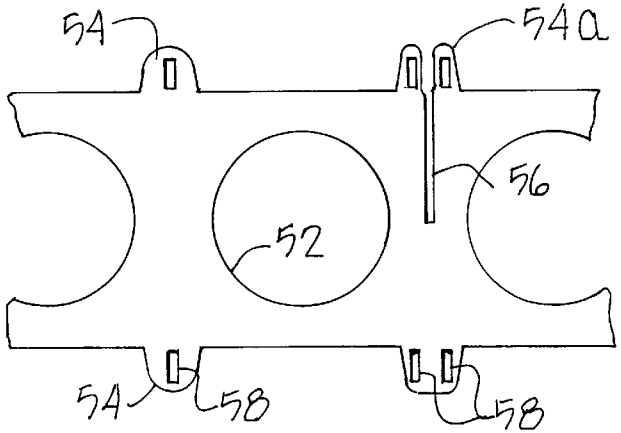
FIG. 5 is an enlarged, fragmentary elevational view of a portion of a longitudinal member of the web core of FIG. 3.

As shown in detail in FIG. 5, each longitudinal member 48 has circular openings 52 therein to reduce its weight, and pairs of opposed projections or tabs 54 that extend upwardly and downwardly from the member 48 at regularly spaced intervals. Every fifth upwardly extending tab 54*a* has an open slot 56 for insertion of a transverse cross member 50. The slots 56 extend through the center of the corresponding tab 54*a* into the longitudinal member 48. The projections 54 and 54*a* also preferably have rectangular openings 58 therein for easier removal thereof.

Figure 4:
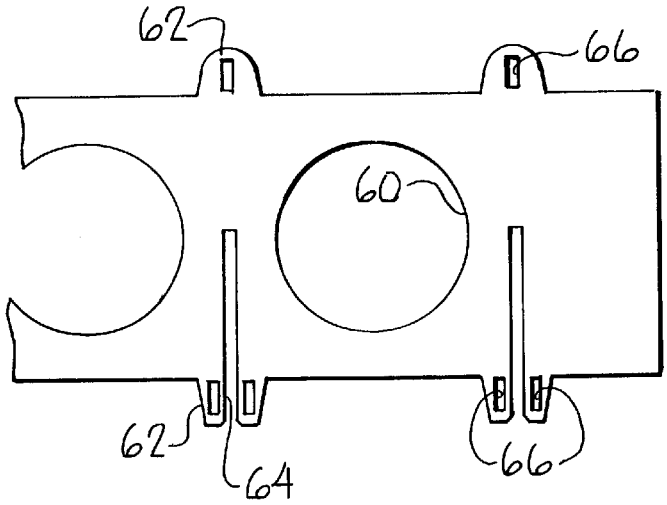
FIG. 4 is an enlarged, fragmentary elevational view of a portion of a transverse cross member of the web core of FIG. 3.
Figure 3:
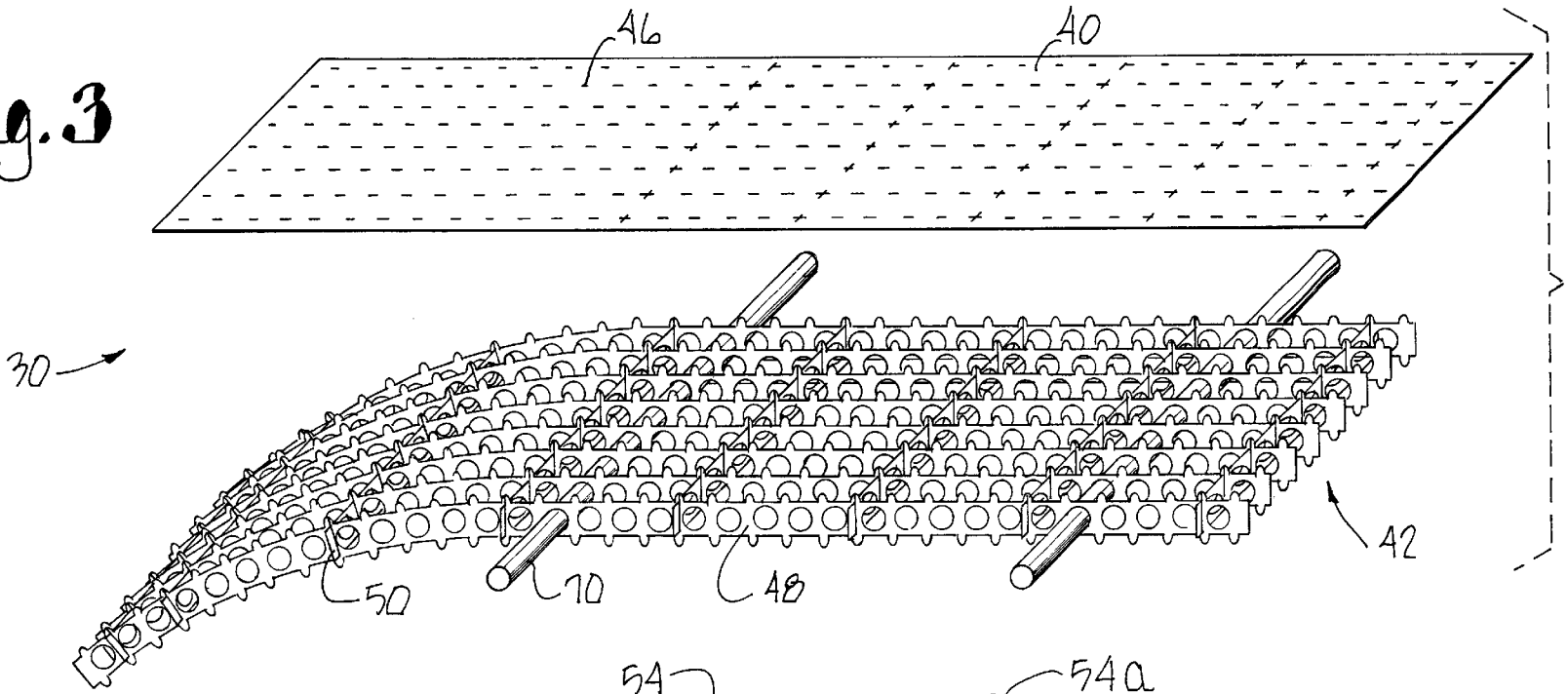
FIG. 3 is an exploded perspective view of the top skin and the web core of the left half of a first embodiment of a panel section in accordance with the present invention.

As shown in detail in FIG. 4, each transverse cross member 50 also has circular openings 60 therein to reduce its weight and pairs of opposed projections or tabs 62 that extend upwardly and downwardly from the member 50 at regularly spaced intervals. Every downwardly extending projection 62 has an open slot 64 for insertion of a longitudinal member 48. The slots 64 extend through the center of the corresponding projection 62 into the transverse cross member 50. The projections 62 have rectangular openings 66 therein to facilitate assembly of panel half 30. The projections 54 and 62 of longitudinal and transverse members 48 and 50 are spaced an equal distance apart.

In addition to weight reduction, it should be appreciated that the openings 52 and 60 in the members 48 and 50 also intercommunicate the core spaces defined by the grid to provide an open interior within the panel. This interior space may be advantageously utilized to provide a duct or channel in the panel, a continuous space for electrical or mechanical runs and/or insulation or other fillers as required by a particular application, or an interior chamber that may be pressurized or evacuated or used for other purposes as desired.

To assemble the web core 42, the desired number of longitudinal members 48 are evenly spaced parallel to one another in their desired configuration with projections 54*a* having slots 56 formed therein being aligned. Longitudinal members 48 may be held in position by a simple jig such as dowels 70 secured by clamps 72 to a table 74 or other surface. See FIGS. 3 and 6. Transverse cross members 50 are then inserted at their slots 64 into the slots 56 of the longitudinal members 48. Thus, the longitudinal members 48 present rows and the transverse cross members 50 present columns of the web core 42. Together they form a grid much in the same manner as partitions of egg crates or boxes for bottled goods.

Figure 6:
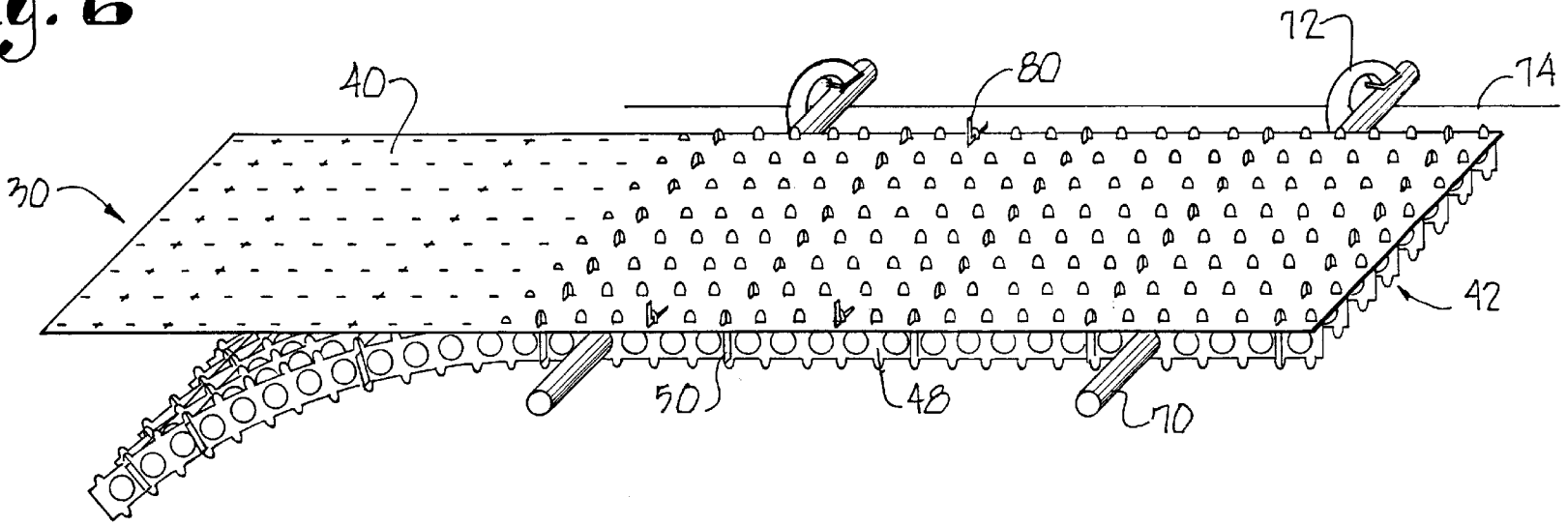
FIG. 6 is a perspective view of the left half illustrated in FIG. 3, showing the top skin being secured by wedge members to the web core thereof.
Figure 8:
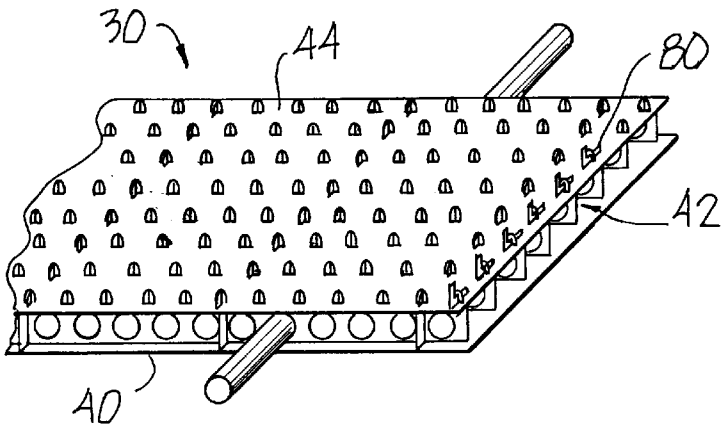
FIG. 8 is a partial perspective view of the left half of FIG. 3 as inverted to show the bottom skin being secured to the web core.
Figure 11:
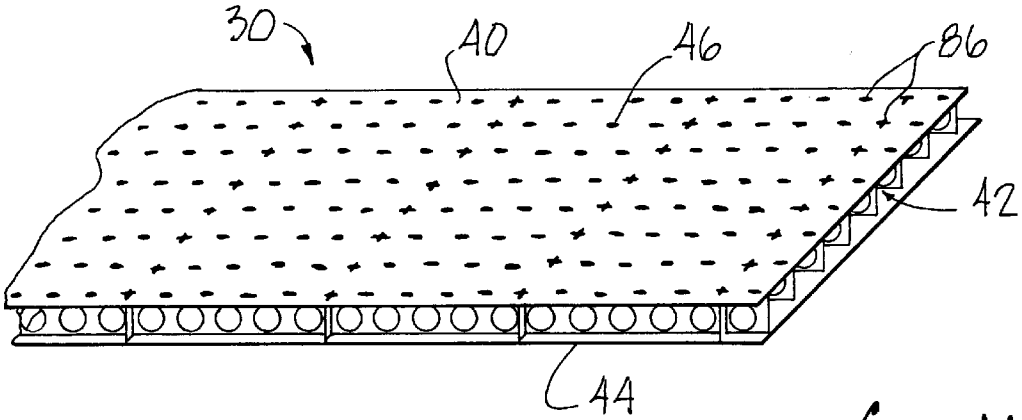
FIG. 11 is a partial perspective of the left half of FIG. 3 showing the panel section assembled.
Figure 7:
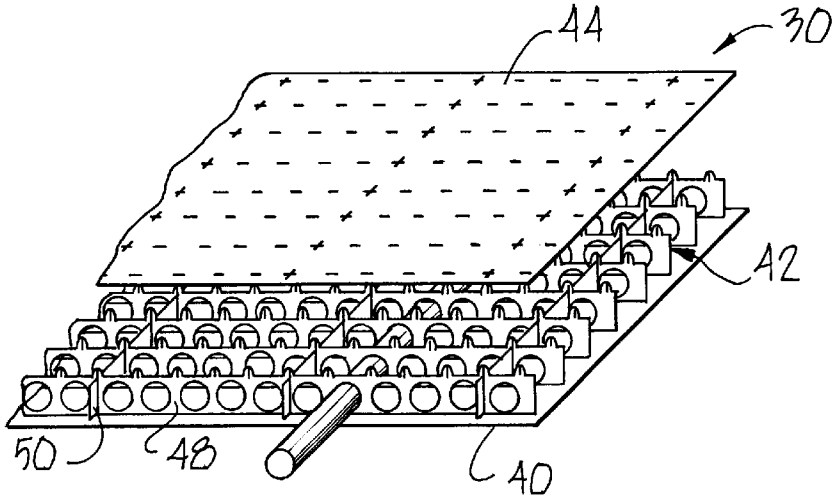
FIG. 7 is a partial exploded perspective view of the left half of FIG. 3 as inverted to show the bottom skin and the web core thereof.

The top and bottom skins 40 and 44 are mounted to the web core 42 with projections 54 and 62 and their corresponding openings 58 and 66 extending through the slits 46 of the skins. In this regard, FIGS. 6 and 8 show the top and bottom skins 40 and 44 being mounted to the web core 42.

Figure 9:
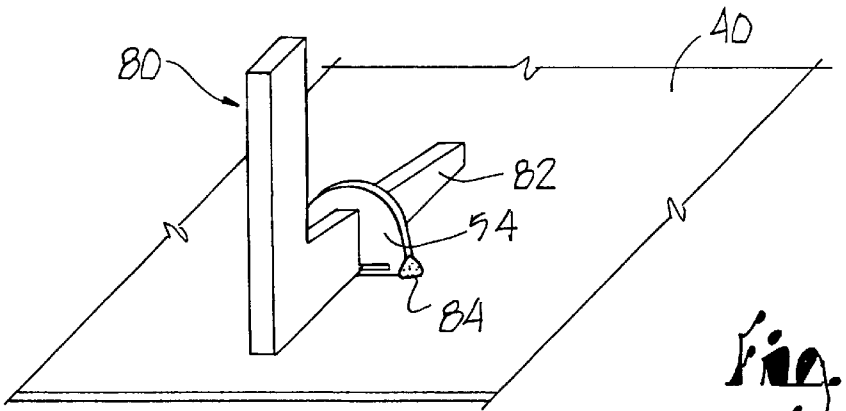
FIG. 9 is a detail view in perspective of a wedge member securing the top skin to the web core, in accordance with the first embodiment of the present invention.
Figure 10:
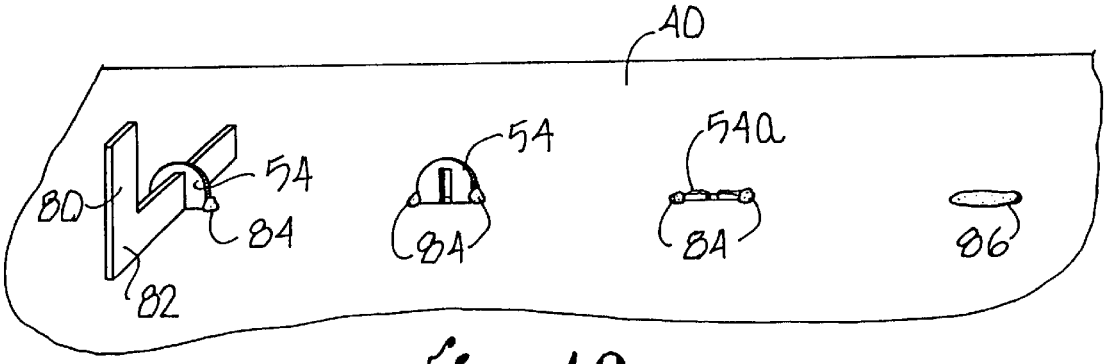
FIG. 10 is a detail view in perspective illustrating the removal of a web core tab and completion of welding, in accordance with the first embodiment of the present invention.

As shown in detail in FIGS. 9 and 10, the skins 40 and 44 are secured to the web core 42 by securing wedges 80 which have a leg 82 that fits snugly within the rectangular openings 58 and 66 of the projections 54 and 62. The projections 54 and 62 are secured at their corners to the corresponding skin 40 or 44 by tack or spot welds 84. The wedges 80 may then be removed, the projections 54 (shown in detail) and 62 (not shown in detail) broken off, see broken projection 54*a* in FIG. 10, and the weld line 86 completed. Bonding methods other than welding may also be used, such as sufficiently strong adhesives. Alternatively, wedges 80 may be placed within the openings 58 and 66, then clamps, such as clamps 72, may be tightened around the skins 40 and 44, the wedges 80 may be removed and the projections 54 and 62 may be welded or otherwise bonded to the skins 40 and 44.

Projections, such as projections 54 and 62, may be used with securing members other than wedges 80, and rectangular slots 58 and 66 therein are not required. For example, wedges 80 may be replaced with a metal strapping system or other sufficiently strong clamping systems.

Figure 12:
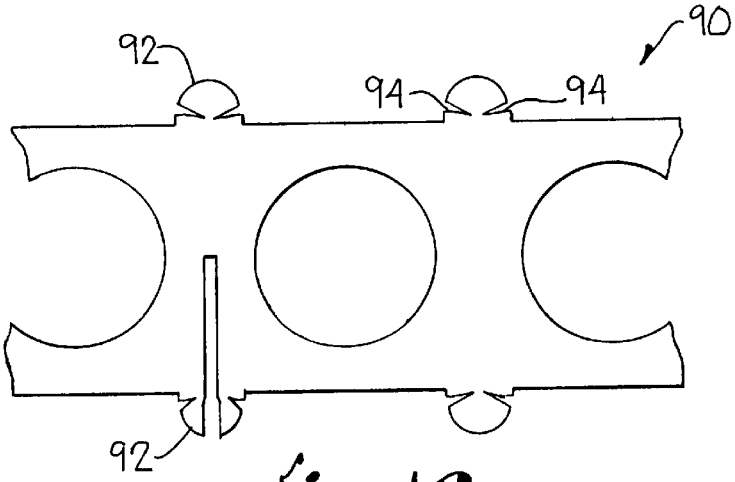
FIG. 12 is an enlarged, fragmentary elevational view of a portion of a modified form of the transverse cross member of FIG. 4, in accordance with the present invention.

FIG. 12 shows a modified form of a transverse cross member 90. It is similar to the transverse cross member 50 but includes differently formed projections 92. Each projection 92 has a pair of opposed twist-off slots 94 extending therein near the base of the corresponding projection 92.

Twist-off slots 94 facilitate the removal of the projections 92 from the transverse cross member 90 and eliminate the need for securing wedges 80. Thus, as shown, the projections 92 do not include slots, such as rectangular slots 58 or 66 of longitudinal and transverse cross members 48 and 50. In use, the twist-off slots 94 allow the projections 92 to be rotated or twisted 90° into a locking position, securing the web core to the plates. After welding or otherwise bonding the projections 92 to the corresponding skin, the projections 92 can be rotated further until they fail and break off. Of course, projections extending from longitudinal members 48 may be similarly configured.

The web core with projections or tabs as discussed above provides the ability to attach the web core to full skins (i.e., skins without securement access holes) from the panel's exterior and yet assemble panels that could be otherwise inaccessible from the edges given their small width.

Although it is possible to build very large single panels using metal skins directly from the supply coil up to about 10' wide (e.g., a single 10'×100' panel), it is more likely to be preferable to construct several panels and connect them together as desired. For example, twenty 5'×10' panels could be connected together to make a larger panel of the required size. Thus, the panel-to-panel connection system for factory or on-site assembly is important to the overall system.

Now referring back to the drawings in this regard, two panel section halves, one being similar to half 30 and the other a mirror image thereof 30*a,* may be joined or secured together as in FIGS. 13–16. The longitudinal seam 22 of FIG. 1 represents these joints.

Figure 13:
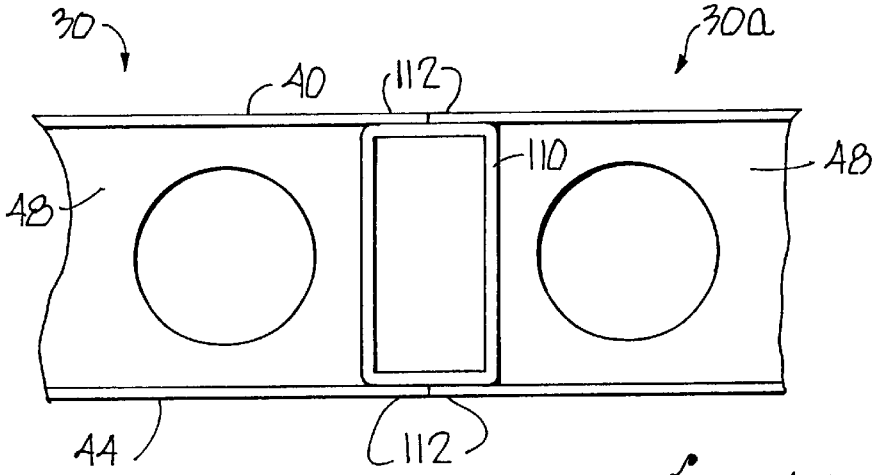
FIGS. 13–16 are enlarged elevational views of alternative joints for securing left and right panel halves of the present invention together to form a panel section.
Figure 14:
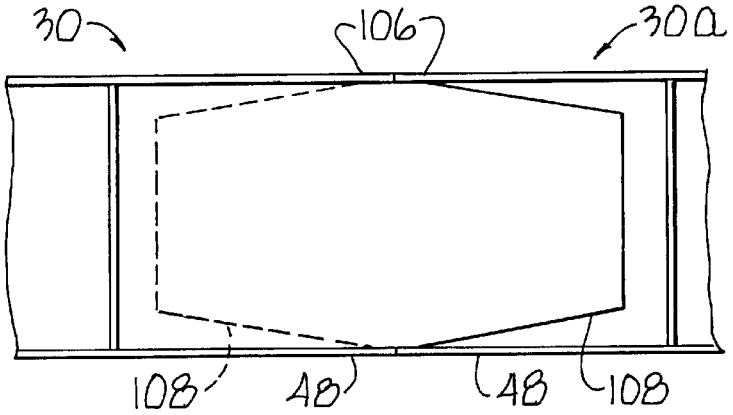

As shown in FIG. 13, the joint between the longitudinal members 48 of halves 30 and 30*a* is formed by backing strips 100 secured by welding or another bonding method in tapered notches 102 above and below the protruding tapered free ends 104 of the longitudinal members 48. As in FIG. 14, the joint is formed by bonding, such as by welding, abutting longitudinal member edges 106 together with tapered protruding guides 108 from the longitudinal members 48 engaging one another to further secure the panel halves 30 and 30*a* together.

Figure 15:
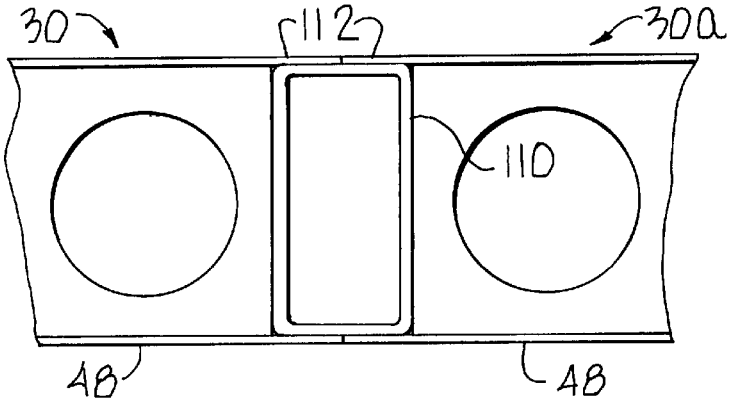

Another joint between panel halves 30 and 30*a* is shown in FIG. 15. Here, a rectangular tube 110 is set between the longitudinal members 48, with one half of the tube 110 extending into each panel half 30 and 30*a*. Abutting longitudinal member edges 112 are bonded together above and below the tube 110.

Figure 16:
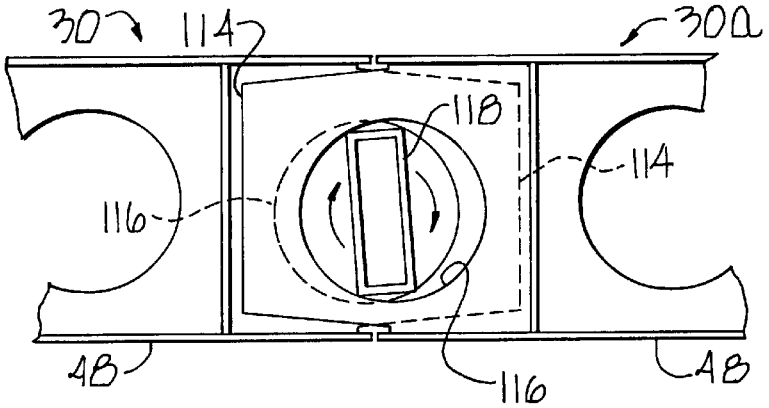

Yet another joint construction is shown in FIG. 16. This joint includes longitudinal members 48 having tapered protruding ends 114 with circular apertures 116 therethrough. Apertures 116 are purposely misaligned. Rotation of rectangular tube 118 within misaligned apertures 116 in the clockwise direction shown cams the halves 30 and 30*a* into a secured locking relationship.

Figure 17:
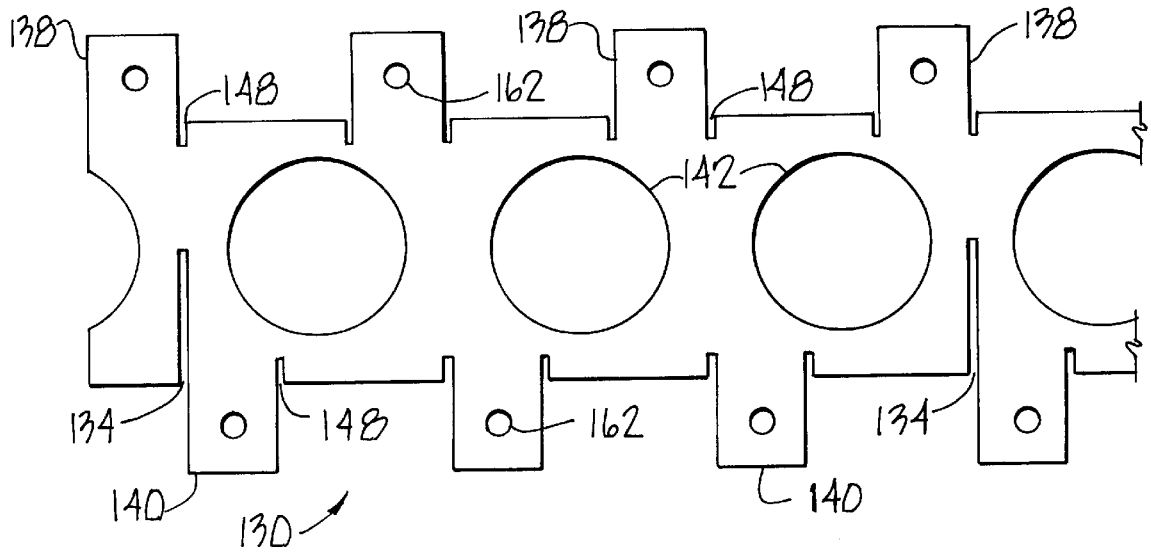
FIG. 17 is an enlarged, fragmentary elevational view of a portion of a transverse cross member in a second embodiment of a panel section of the present invention.
Figure 18:
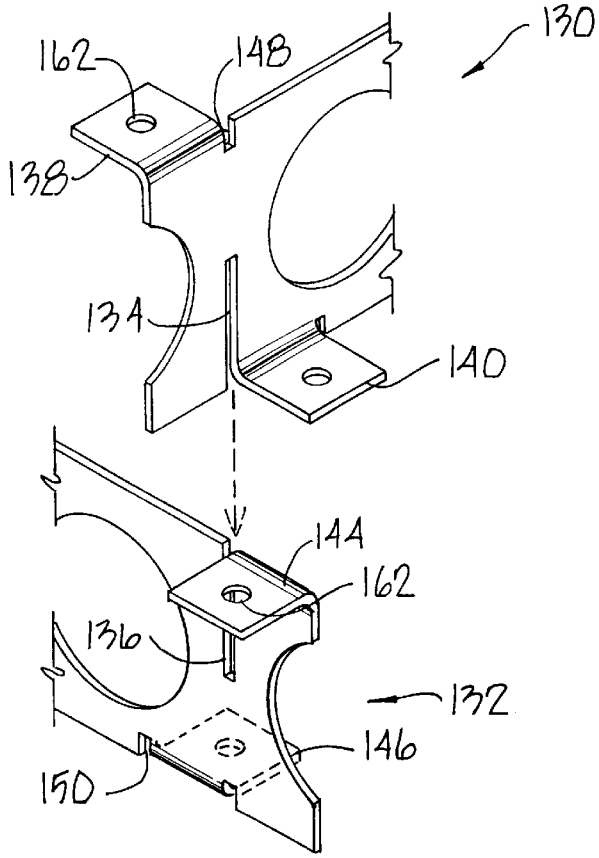
FIG. 18 is a fragmentary, exploded view showing the junction of the cross member of FIG. 17 and a longitudinal member of the web core of the second embodiment.

Referring to FIGS. 17–20, details of the web core construction of a second embodiment of a panel section of the present invention are shown. A transverse cross member 130 of the web core is similar to the cross member 50 of the first embodiment in that it comprises an elongated strip of sheet material configured to interfit with a longitudinal or primary member 132 as illustrated in FIG. 18 where a junction of the two core members at a corner of the panel is shown. An open slot 134 in the lower half of cross member 130 (in the orientation of the components seen in FIGS. 17 and 18) is inserted into a corresponding slot 136 in the upper half of longitudinal member 132 to assemble the core. As in the first embodiment, the slots 134 and 136 are repeated at regular intervals as desired to form a grid core having the desired spacing between the longitudinal and transverse members. Two such slots 134 for cross member 130 are illustrated in FIG. 17.

Initially before combining members 130 and 132, the cross member 130 has the configuration shown in FIG. 17 where it may be seen that a series of spaced projections in the form of rectangular ears 138 extend from the upper longitudinal edge of member 130 essentially in the same plane as the body of the member, and a series of opposing projections or ears 140 project from the lower longitudinal edge thereof. Each pair of opposing ears 138, 140 is offset such that, as viewed in FIG. 17, the right edge of ear 138 is in substantial alignment with the left edge of opposing ear 140. Thus, at each slot 134, the ears 138 and 140 are on the left and right sides thereof as viewed in FIG. 17. As in the first embodiment, longitudinally spaced circular openings 142 reduce the weight of member 130.

The longitudinal members 132 of the grid core have the same configuration as the cross members 130, except that the slots 136 therein extend from the upper edge of each member 132 to approximately the center of the material, as is apparent in FIG. 18. Accordingly, each longitudinal member 132 likewise has a row of outwardly projecting ears 144 on one longitudinal edge thereof, and a row of outwardly projecting ears 146 on the opposite longitudinal edge thereof, with opposing ears 144, 146 being offset. It should also be noted that notches 148 at the base of each ear 138 or 140 of member 130, and notches 150 at the base of each ear 144 or 146 of member 132, enable each of the ears to be readily bent to a position at right angles to the plane of the member as illustrated in FIG. 18 to provide a means for mounting the top and bottom skins 152 and 154 thereto as illustrated in FIGS. 19 and 20.

Figure 19:
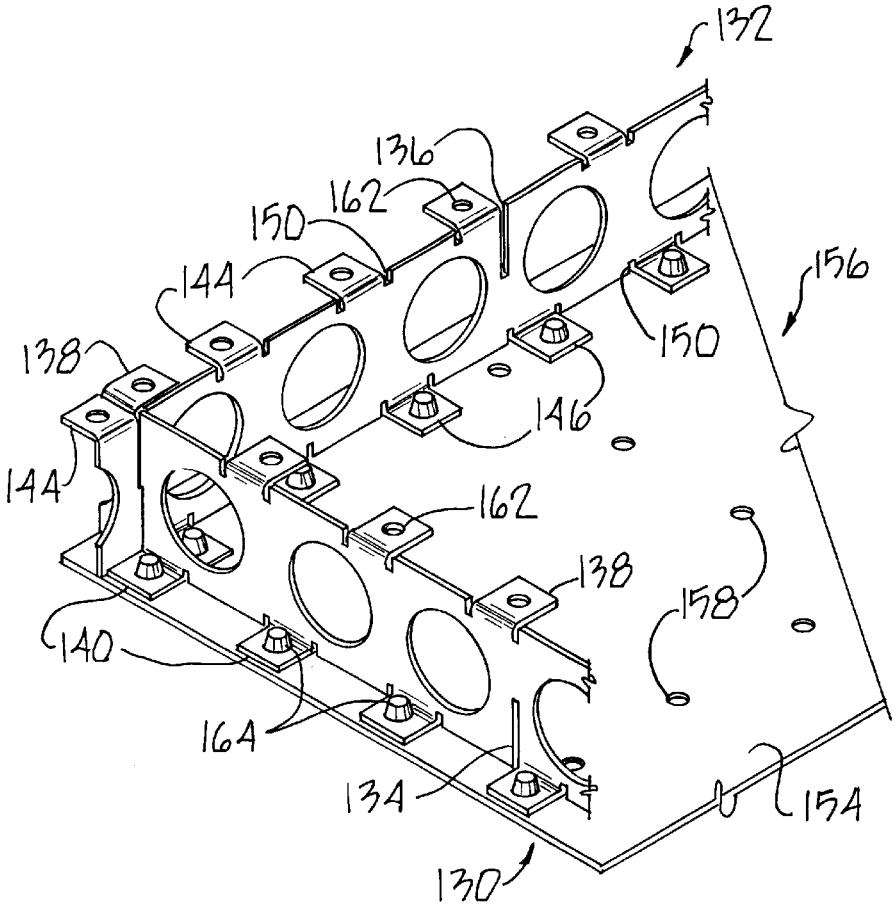
FIG. 19 is a partial perspective view of the panel section of the second embodiment, showing the panel under fabrication with no top skin as yet installed.

In FIG. 19 a panel section 156 is shown in a partial view during assembly. The bottom skin 154 has regularly spaced openings 158 therein corresponding to the grid pattern, i.e., rows and columns of the web core that will be provided by the longitudinal members 132 and the transverse cross members 130. These openings 158 (and similarly arranged openings 160 in top skin 152) are aligned with corresponding openings 162 in the ears 138, 140, 144 and 146 of the core members. FIG. 19 illustrates the stage of assembly at one corner of the panel section 156 before the addition of the top skin 152. Fasteners 164 are shown installed through respective openings 158 in bottom skin 154 and the openings 162 in ears 140 and 146 to connect the grid with the bottom skin 154. It should be appreciated that, for clarity, the other longitudinal and cross members that would be inserted at slots 134 and 136 are omitted in FIG. 19. Fasteners 164 of any suitable type may be used, such as the Huck C6L/C120L fastening system.

Figure 20:
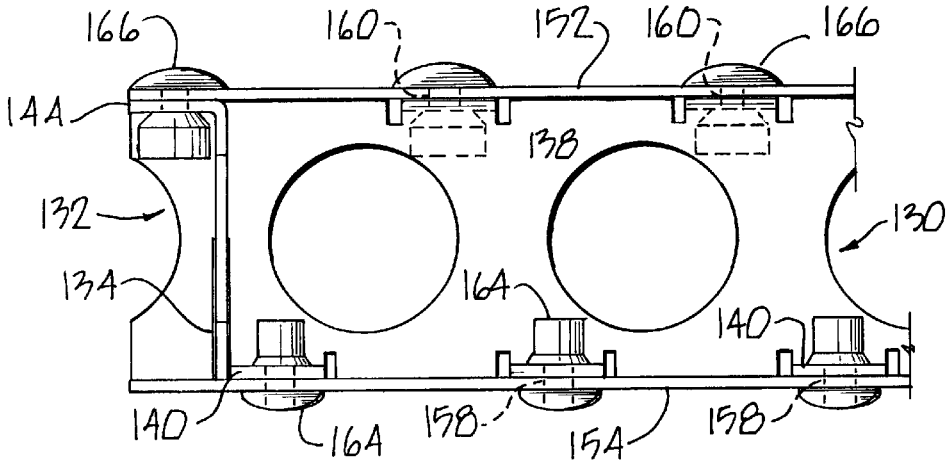
FIG. 20 is an enlarged elevational view of one corner of the panel of FIG. 19 with all components installed.

FIG. 20 is an enlarged elevational view showing the corner of panel section 156 seen in FIG. 19, upon installation of the top skin 152 and completion of fabrication. It will be appreciated that the interior of panel section 156 is not accessible at this last step of fabrication when top skin 152 is placed over the upper ears 138 and 144 with holes 160 in skin 152 and holes 162 in ears 138 and 144 in register. Therefore, blind fasteners 166 are installed from the top side of the panel section and extend through holes 160 and 162 as seen in FIG. 20 to join the top skin 152 with the grid. A suitable fastener for this purpose is a Huck MS20600 blind rivet.

Figure 21:
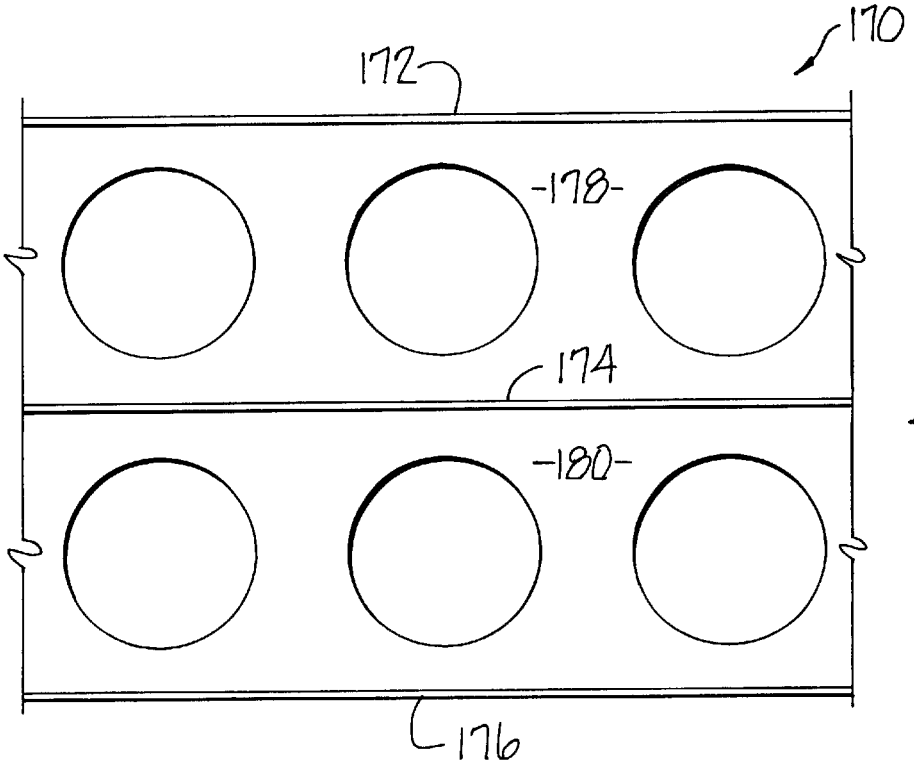
FIG. 21 is a partial elevational view of an alternative three skin configuration of the panel system in accordance with the present invention.
Figure 22:
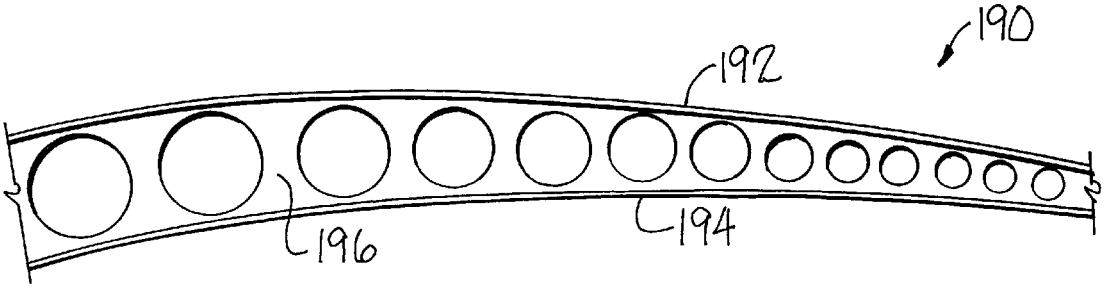
FIG. 22 is a partial elevational view showing the paneling of the present invention having a progressively varying width.

FIGS. 21 and 22 show alternative configurations of the paneling system. The panel 170 of FIG. 21 provides a double wall of protection (such as against leakage in fluid storage tanks) and includes three skins 172, 174 and 176 secured together by two web cores 178 and 180 as previously described herein. The panel 190 of FIG. 22 is very similar to panel half 30 but has its skins 192 and 194 secured together by a web core 196 of a progressive decreasing width as viewed from left to right. Thus, these figures further illustrate the panel system's adaptability for a variety of applications.

Having thus described the invention, what is claimed as new and desired to be secured by Letters Patent is as follows:

1. A structural panel comprising:

a first skin, a second skin, a web core securing said skins together in a spaced relationship, including a plurality of spaced-apart elongated primary members having longitudinally spaced projections extending therefrom and further having transversely aligned, longitudinally spaced slots therein extending through corresponding projections, said web core further including a plurality of spaced-apart cross members each having spaced slots therein receiving said primary members at corresponding transversely aligned slots thereof to provide an interlocked grid work between said first and second skins, and means cooperating with said projections for connecting said primary members to the respective skins to provide a rigid panel structure.

2. The structural panel as claimed in claim 1, wherein each of said primary and cross members is composed of a sheet material of desired thickness.

3. The structural panel as claimed in claim 1 wherein said connecting means includes welds or adhesive bonds at said projections.

4. The structural panel as claimed in claim 1, further comprising means for connecting a plurality of said panels together.

5. The structural panel as claimed in claim 4 wherein the last mentioned means for connecting includes strip members bonded to free ends of adjacent panels.

6. A structural panel system comprising:

a plurality of panel members;

means for coupling said panel members together;

each said panel member having:

a first skin;

a second skin; and a web core member securing said skins together in a spaced relationship and including a plurality of spaced-apart primary members and spaced-apart cross members, each of said primary members including spaced projections extending from opposed sides thereof through respective skins, at least some of said projections having a first slot extending therethrough and into the associated primary member, each of said cross members mounted to said primary members of a corresponding panel at a plurality of spaced-apart second slots extending partially through said cross member, one said second slot being received within one said first slot, said members thereby presenting said web core, and means for bonding said projections to the respective skins to provide a rigid panel structure.

7. The structural panel system as claimed in claim 6 wherein said means for bonding includes welds at said projections.

8. The structural panel system as claimed in claim 6 wherein said cross members include spaced projections extending therefrom through said first and second skins.

9. The structural panel system as claimed in claim 8 wherein said spaced slots of said cross members extend through corresponding projections thereof.

10. The structural panel system as claimed in claim 6 wherein said means for coupling includes strip members bonded to free ends of adjacent panel members.

11. A structural panel comprising:

a first skin, a second skin, a web core securing said skins together in a spaced relationship, including a plurality of spaced-apart elongated primary members having longitudinally spaced projections extending therefrom and further having transversely aligned, longitudinally spaced slots therein, said web core further including a plurality of spaced-apart cross members having spaced projections extending therefrom and further having spaced slots therein extending through corresponding projections and receiving said primary members at corresponding transversely aligned slots thereof to provide an interlocked grid work between said first and second skins, and means cooperating with said projections for connecting said primary and cross members to the respective skins to provide a rigid panel structure.

12. A lightweight structural panel comprising:

a first skin, a second skin, a web core sandwiched between said skins to maintain the skins in a fixed, spaced relationship, including a plurality of elongated, relatively thin, spaced-apart primary members having transversely aligned, longitudinally spaced slots therein, said web core further including a plurality of elongated, relatively thin, spaced-apart cross members having longitudinally spaced slots therein receiving said primary members at corresponding transversely aligned slots thereof to provide an interlocked grid work between said first and second skins, said first and second skins spanning said grid work to present opposed faces of said panel, and means for securing said web core and skins together, comprising longitudinally spaced mounting ears on said primary and cross members positioned generally parallel to respective skins, and a plurality of fasteners securing said skins to said ears to present a rigid panel structure.

13. A lightweight structural panel comprising:

a first skin, a second skin, a web core sandwiched between said skins to maintain the skins in a fixed, spaced relationship, including a plurality of elongated, relatively thin, spaced-apart primary members having transversely aligned, longitudinally spaced slots therein, said web core further including a plurality of elongated, relatively thin, spaced-apart cross members having longitudinally spaced slots therein receiving said primary members at corresponding transversely aligned slots thereof to provide an interlocked grid work between said first and second skins, said first and second skins spanning said grid work to present opposed faces of said panel, and means for securing said web core and skins together, comprising longitudinally spaced projections extending from said primary and cross members in opposed directions through respective skins, and welds or adhesive bonds at said projections joining said primary and cross members to the respective skins at each projection to present a rigid panel structure.

14. A structural panel system for a railroad car comprising:

a plurality of panel members adapted to provide an enclosure over a load carried by a railroad car;

means for joining said panel members together to present said enclosure; and each of said panel members having:

a first skin, a second skin, a web core sandwiched between said skins to maintain the skins in a fixed, spaced relationship, including a plurality of elongated, relatively thin, spaced-apart primary members having transversely aligned, longitudinally spaced slots therein, said web core further including a plurality of elongated, relatively thin, spaced-apart cross members having longitudinally spaced slots therein receiving said primary members at corresponding transversely aligned slots thereof to provide an interlocked grid work between said first and second skins, said first and second skins spanning said grid work to present opposed faces of said panel, and means for securing said web core and skins together, comprising longitudinally spaced projections extending from said primary and cross members in opposed directions through respective skins, and welds or adhesive bonds at said projections joining said primary and cross members to the respective skins at each projection to present a rigid panel structure.

* * * * *